US007040693B1

(12) United States Patent
Dorner et al.

(10) Patent No.: US 7,040,693 B1
(45) **Date of Patent: *May 9, 2006**

(54) EXTENSIBLE SEATING ARTICLE AND MECHANISM

(75) Inventors: Randall L. Dorner, Howards Grove, WI (US); Scott Reynolds, Sheboygan, WI (US)

(73) Assignee: Nemschoff Chairs, Inc., Sheboygan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,004

(22) Filed: Apr. 9, 2002

Related U.S. Application Data

(63) Continuation of application No. 09/325,889, filed on Jun. 4, 1999, now Pat. No. 6,367,873.

(51) Int. Cl.
*A47C 13/00* (2006.01)

(52) U.S. Cl. ..... 297/110; 297/118; 297/378.1

(58) Field of Classification Search ..... 297/110, 297/118, 7, 9, 10, 354.12, 1, 233, 234, 236, 297/257, 108, 109, 378.1, 378.12
See application file for complete search history.

(56) References Cited

U.S. PATENT DOCUMENTS

| | | | | |
|---|---|---|---|---|
| 82,482 | A | 9/1868 | Blood | |
| 124,765 | A | 3/1872 | Schafer | |
| 321,540 | A * | 7/1885 | Shaber | 297/108 X |
| 327,605 | A | 10/1885 | Shaw | |
| 521,463 | A | 6/1894 | Smith-Fraser | |
| 755,089 | A | 3/1904 | Wersel, Jr. | |
| 923,529 | A | 6/1909 | Engrahm | |
| 1,024,944 | A * | 4/1912 | Druyun | 297/108 |
| 1,061,533 | A * | 5/1913 | Englander | 297/108 |
| 1,362,444 | A | 12/1920 | Spector et al. | |
| 1,702,955 | A | 2/1929 | Zaday | |
| 1,789,245 | A | 1/1931 | McIntyre | |
| 1,836,315 | A * | 12/1931 | Druyun | 297/108 |
| 2,147,374 | A * | 2/1939 | Lanquist | 297/110 X |
| 2,187,713 | A | 1/1940 | Bowersox | |
| 2,486,716 | A | 11/1949 | Kuebler | |
| 2,650,644 | A * | 9/1953 | Malco | 297/108 X |
| 2,661,047 | A | 12/1953 | Blanken | |
| 2,714,418 | A * | 8/1955 | Malco | 297/119 X |
| 2,937,384 | A | 5/1960 | Fossum | |
| 3,107,940 | A | 10/1963 | Brooks et al. | |
| 3,151,342 | A | 10/1964 | McLean | |
| 3,284,126 | A | 11/1966 | Piazza | |
| 3,348,878 | A | 10/1967 | Rogers, Jr. | |
| 3,385,631 | A | 5/1968 | Gertler | |
| 3,913,152 | A | 10/1975 | Quakenbush | |
| 4,099,275 | A | 7/1978 | Pallan | |
| 4,204,287 | A | 5/1980 | Lane et al. | |
| 4,216,992 | A | 8/1980 | Crum | |
| 4,221,428 | A | 9/1980 | Bowman et al. | |
| 4,366,585 | A | 1/1983 | Ponti et al. | |
| 4,439,878 | A | 4/1984 | Stevens | |
| 4,481,684 | A | 11/1984 | Hauck | |
| 4,543,675 | A | 10/1985 | Shrock | |
| 4,577,902 | A | 3/1986 | Crum | |
| 4,586,206 | A | 5/1986 | Singer | |
| 4,608,722 | A | 9/1986 | Zorzetto | |
| 4,627,663 | A | 12/1986 | LaPointe | |

(Continued)

*Primary Examiner*—Anthony D. Barfield
(74) *Attorney, Agent, or Firm*—Reinhart Boerner VanDeuren s.c.

(57) ABSTRACT

An extendable chair and mechanism for use therewith to provide a substantially horizontal rest surface. A fully supported surface is available through extension of an attractive upright chair.

18 Claims, 6 Drawing Sheets

U.S. PATENT DOCUMENTS

| | | | |
|---|---|---|---|
| 4,662,673 | A | 5/1987 | Crum |
| 4,696,512 | A | 9/1987 | Burnett et al. |
| 4,717,169 | A | 1/1988 | Shaffer |
| 4,762,364 | A | 8/1988 | Young |
| 4,803,742 | A | 2/1989 | Rasnick et al. |
| 4,805,960 | A | 2/1989 | Tacker |
| 4,815,788 | A | 3/1989 | May |
| 4,826,243 | A | 5/1989 | Lawson |
| 4,862,529 | A | 9/1989 | Peck |
| 4,878,710 | A | 11/1989 | Tacker |
| 5,011,220 | A | 4/1991 | LaPointe |
| 5,072,988 | A | 12/1991 | Plunk |
| 5,090,768 | A | 2/1992 | Re et al. |
| 5,101,524 | A | 4/1992 | Brandschain |
| 5,137,328 | A | 8/1992 | Smith et al. |
| 5,141,284 | A | 8/1992 | LaPointe |
| 5,147,108 | A | 9/1992 | LaPointe |
| 5,156,441 | A | 10/1992 | Byersmith et al. |
| 5,169,208 | A | 12/1992 | Re et al. |
| 5,222,286 | A | 6/1993 | Saul et al. |
| 5,271,660 | A | 12/1993 | LaPointe et al. |
| 5,292,170 | A | 3/1994 | LaPointe et al. |
| 5,682,629 | A | 11/1997 | Bortoluzzi |
| 5,743,594 | A | 4/1998 | Suskey et al. |
| 5,779,310 | A | 7/1998 | Suskey et al. |
| 6,367,873 | B1 | 4/2002 | Dorner et al. |

* cited by examiner

FIG. 1
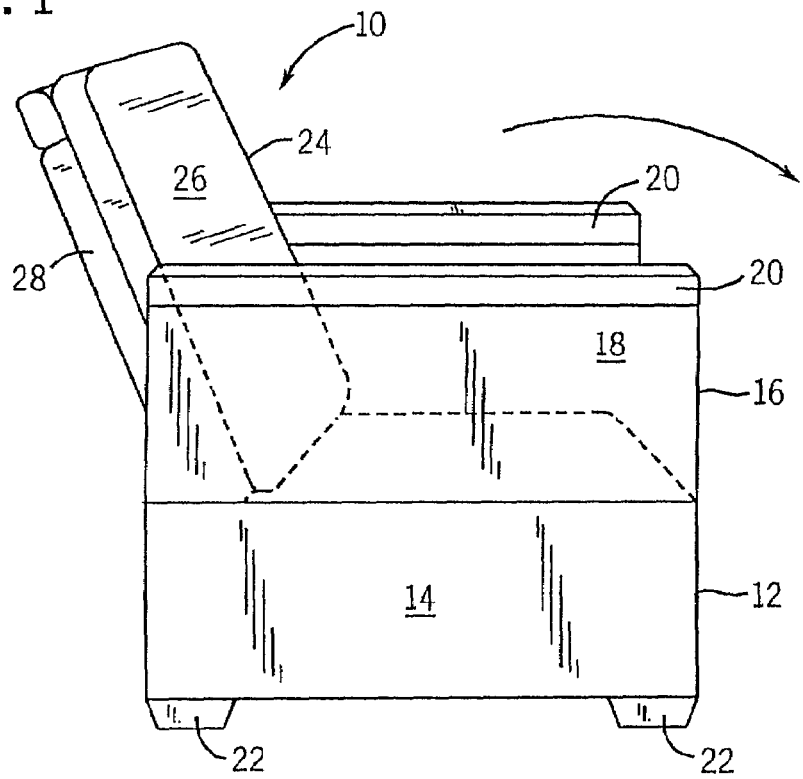
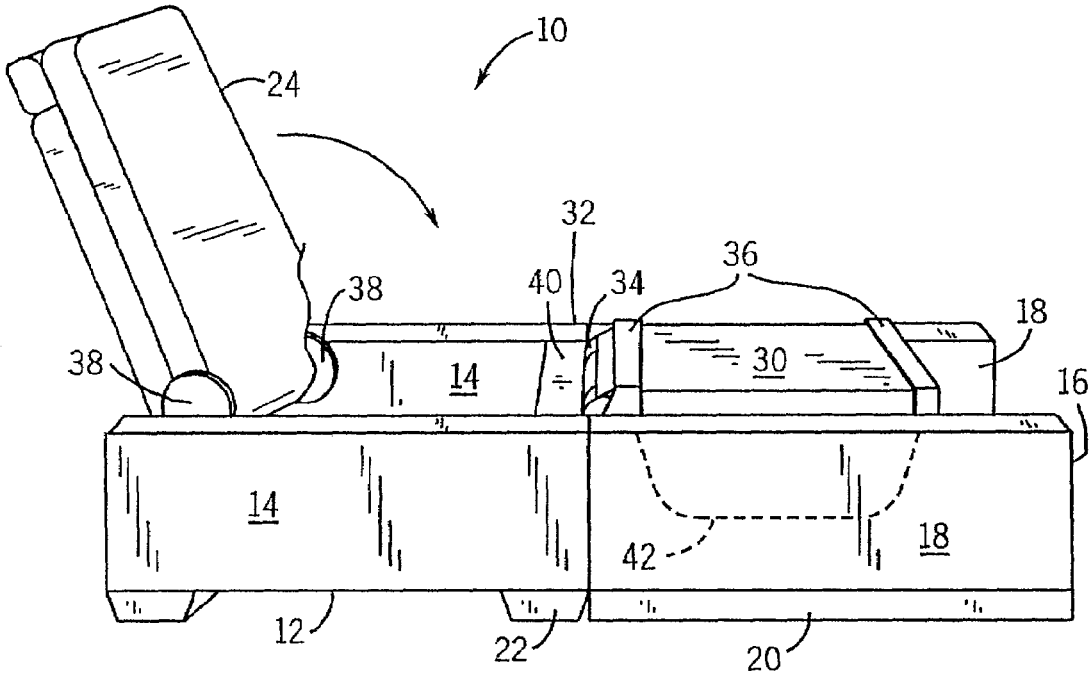
FIG. 2

FIG. 3
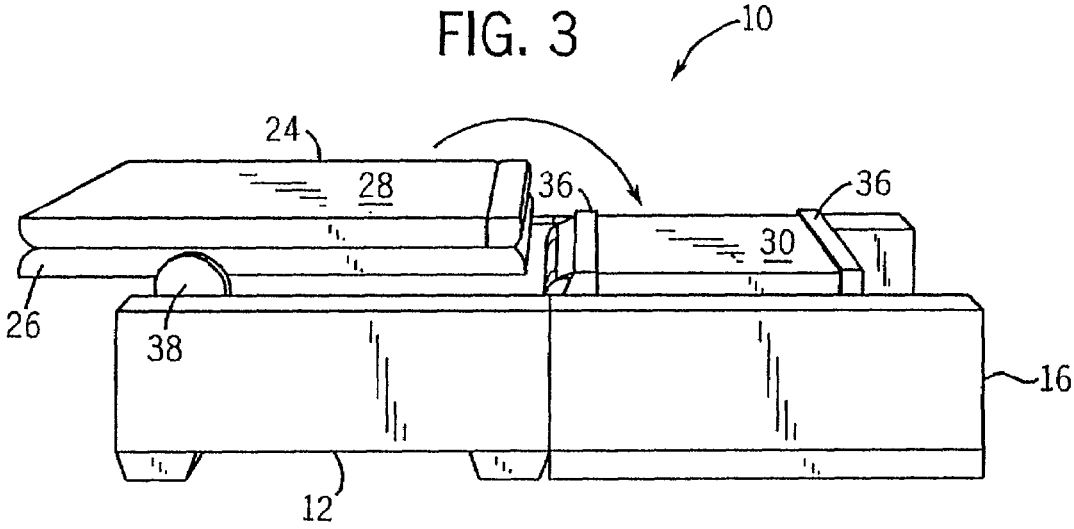
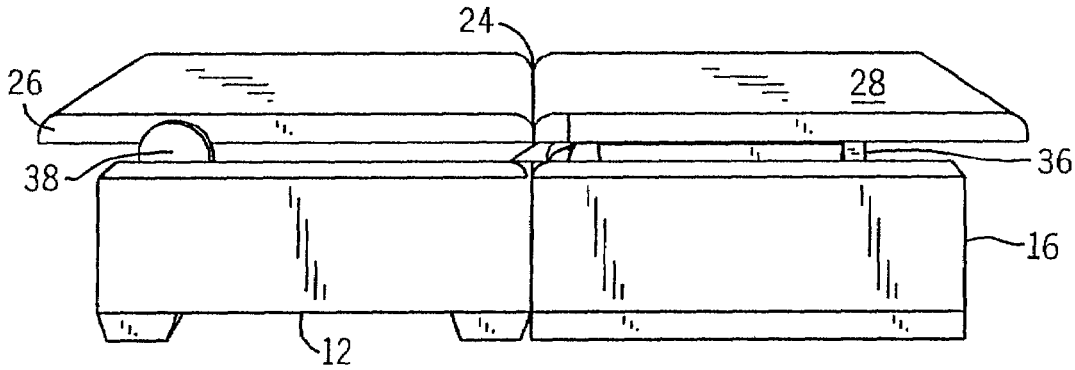
FIG. 4

EXTENSIBLE SEATING ARTICLE AND MECHANISM

This application is a continuation of U.S. application Ser. No. 09/325,889, filed on Jun. 4, 1999, which will issue as U.S. Pat. No. 6,367,873 on Apr. 9, 2002, and claims priority benefit therefrom.

This invention relates generally to multi-function seating articles and, more particularly, to chairs having extensible mechanisms which operate to move the seat portion of such an article to a position distal from a back rest portion converted to a sleeping surface.

Typically, reclinable chairs do not extend to a completely horizontal resting surface. The extending and tilting linkages/mechanisms utilized are limited to the extent that the back rest and seat portions are about 15–30 degrees from fully horizontal. The surface so obtained is less than optimal for a variety of reasons. Long periods of restful sleep are often not possible. Even so, the oblique back rest-seat angle inherent to such mechanisms presents disadvantages for those experiencing lower back and associated ailments or those accustomed to a variety of sleeping positions.

As mentioned above, reclinable chairs of the prior art incorporate various extending and tilting linkages to achieve one or more reclined positions. The hinged or coupled joints of such linkages are often exposed and, upon closing, present a hazard to the unwary. Furthermore, these linkages are comprised of numerous movable parts, and the failure of any would cause malfunction of the entire linkage.

Several reclinable chairs of the prior art have standard telescopic mechanisms which necessitate inconvenient cushion rearrangement upon conversion. The requisite degree of comfort and aesthetics in both the sitting and reclining positions is seldom provided. Furthermore, such chairs do not utilize the back rest portion as part of the sleeping surface and, as a result, tend to occupy an inordinate amount of floor space.

The prior art has associated with it a number of significant drawbacks. Most are related to performance and positional deficiencies and result from the type of extending and tilting mechanisms currently employed. There is a proven need for an alternative convertible extensible seating article and an extending mechanism for use in conjunction therewith to afford a comfortable sleeping or rest surface.

BRIEF DESCRIPTION OF THE DRAWINGS

FIG. 1 is a side view of a chair, in accordance with the extensible seating articles of this invention.

FIG. 2 is a perspective view of the chair article and/or mechanism of FIG. 1, showing extension thereof.

FIG. 3 illustrates partial conversion of the chair article of FIGS. 1 and 2 to a substantially horizontal surface.

FIG. 4 illustrates full extension and conversion of the article first illustrated in FIG. 1.

SUMMARY OF THE INVENTION

Figure 5:
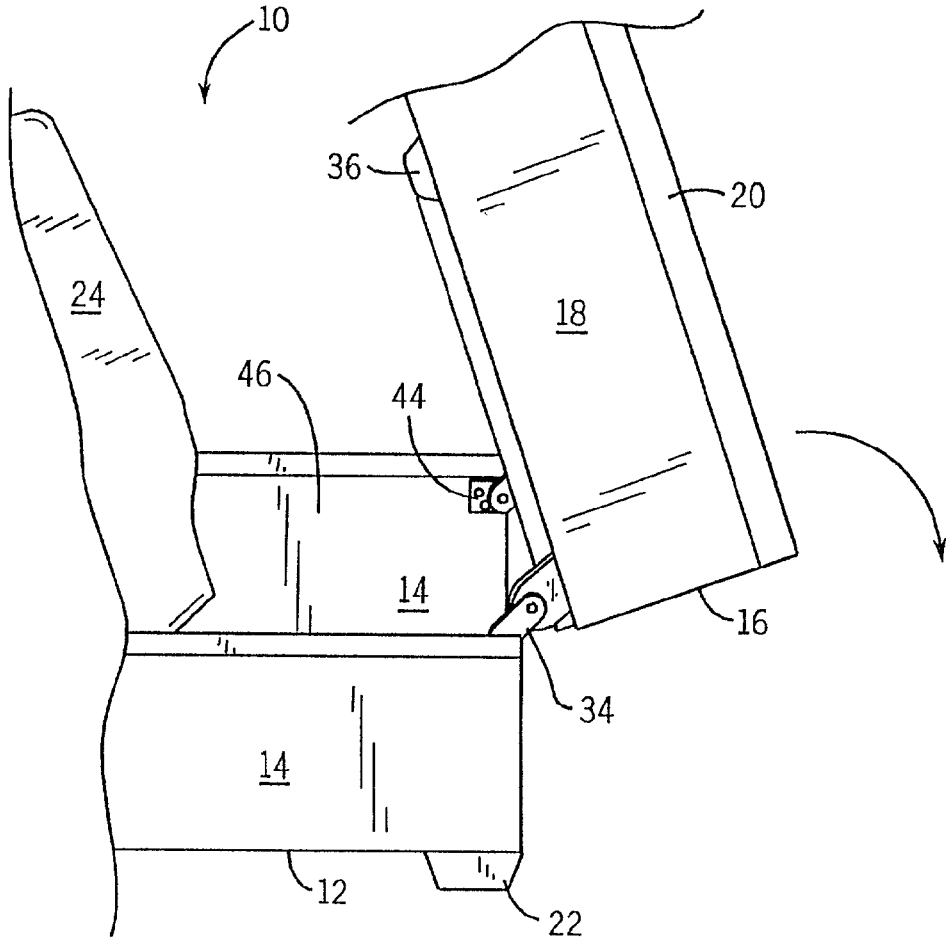
FIG. 5 illustrates, in partial fragmentary view, various components utilized in the extension of the subject chair and/or mechanism, in accordance with the broader considerations relating to this invention.

Accordingly, it is an object of the present invention to overcome the problems and deficiencies of the prior art, including those described above. It will be understood by those skilled in the art that one or more aspects of this invention can meet certain objectives, while one or more other aspects can meet certain other objectives. Each objective may not apply equally, in all instances, to every aspect of the present invention. As such, the following objects can be viewed in the alternative with respect to any one aspect of the present invention.

It can also be an object of the present invention to provide a chair and extensible mechanism which can be used in conjunction therewith to reversibly convert the article chair from a sitting to a supine rest position.

It is an object of the present invention to provide an upright seating article convertible to a sleeping surface which when contracted provides a seat portion angled acutely with respect to a corresponding back rest.

It is an object of the present invention to provide a mechanism usable in conjunction with a convertible chair which imparts to the chair various wall-proximate characteristics upon reversible conversion to a supine and/or horizontal position.

It is an object of the present invention to provide an extensible mechanism for use with a convertible seating article such that the cushion members and cushion covers of such an article can be removed for cleaning or repair without interrupting the function of the chair extension mechanism.

It is an object of the present invention to provide an extendable chair and mechanism for chair extension that can be adapted or modified, without interrupting or substantially changing mechanism function, to incorporate various other components.

An object of the present invention can be to provide a convertible, extensible seating article, such as but not limited to a chair, and/or a related mechanism which protects and prolongs the functional and aesthetic life of a seat portion by positioning it opposite a resulting weight-bearing horizontal surface.

It is an object of the present invention to provide a mechanism usable and in conjunction with a convertible chair which minimizes the injury potential associated with mechanism retraction.

It is an object of the present invention to provide a mechanism useful in conjunction with a convertible chair such that the seat portion of such a chair can be moved to a position distal to the back rest to permit the seat portion to support a back rest and provide a horizontal sleeping surface.

It is an object of this invention to provide an extensible mechanism which can be used with or without a wheel base assembly or other such component(s) which assist in movement and/or placement of a convertible chair.

It is an object of this invention to provide an extensible mechanism of the kind which can be extended upon pivot or angular movement of the seat portion of the article upward and/or forward.

Other objects, features and advantages of the present invention will be apparent from this summary and descriptions of preferred embodiments provided herein, and will be especially apparent to those skilled in the art having knowledge of various furniture articles and their construction. Such objects, features and advantages will be apparent from the above as taken in conjunction with the accompanying figures and all reasonable inferences to be drawn therefrom.

In part, the present invention is a chair extendable into a substantially horizontal supine surface. Such a chair can include (1) a stationary frame with two vertical side members defining a cross-dimension, with each side member having a back end and a forward end; (2) a seat portion with an upper surface and a lower surface, the lower surface pivotably coupled forward to a stationary frame side member; and (3) a back rest member pivotably coupled to the stationary frame. The seat member of such a chair can include opposed side members, such that the seat portion can also have a cross-dimension thereby defined. In preferred embodiments, the cross-dimension of the seat portion is substantially the same as the cross-dimension of the stationary frame. In highly preferred embodiments, each opposed seat side member has a vertical dimension substantially the same as the vertical dimension of each stationary frame side member.

The lower surface or portion of the seat portion can have at least one back rest support member. Preferred embodiments of the present invention include two back rest support members on the lower surface. Such support members can be attached to each of the opposed seat side members. In highly preferred embodiments, the vertical dimension of each side member, together with such support members, positions the back rest member in a substantially horizontal position as the chair is extended, as described herein.

The present invention contemplates use of a unitary back rest member. However, the advantages and benefits of the present invention are best realized utilizing a back rest member having first and second rest portions. In such embodiments, a first rest portion is coupled to and facing a second rest portion. In preferred embodiments, the second rest portion is extensibly coupled behind the first rest portion. In such embodiments, the first rest portion, when pivoted, and the second rest portion, when extended, together provide a substantially horizontal rest surface. In highly preferred embodiments, the pivoted first portion is positioned on the stationary frame and the extended second portion is positioned on the seat portion.

In part, the present invention can also include (1) a stationary frame having two vertical side members defining a cross-dimension, with each such side member having a back end and a forward end, and the forward end including a cross-member; (2) a back rest member coupled pivotably forward to the stationary frame; and (3) a seat portion having an upper surface and a lower surface, the lower surface pivotably coupled forward to the stationary frame side member and including a back rest support member. As described more fully above, the seat portion of such a chair can include opposed edge members, such members defining a cross-dimension which can, but is not required, to be the same as the cross-dimension of the stationary frame. Likewise, the vertical dimensions of the opposed seat side members can be substantially the same or comparable to the vertical dimension of each stationary frame side member.

In preferred embodiments, the back rest support member on the lower seat surface or portion can bridge the opposed seat side members. As further detailed herein, such a support member can have an angular configuration complementary to the configuration of the stationary frame cross-member. In such embodiments, coupling the seat portion on the stationary frame provides for a substantially right angular relationship between the front end of the stationary frame and the seat portion coupled thereto.

In part, the present invention is also a mechanism for extending an upright seating surface to a substantially horizontal sleeping surface. Such a mechanism can include (1) a stationary frame having a back end, a forward end and a cross-dimension defined by opposed vertical side members; (2) a seat frame member angularly movable with respect to the stationary frame from a position on the forward end of the stationary frame. Such a seat frame member can also have opposed upper and lower surfaces/portions, together with opposed vertical side members. In preferred embodiments, the seat frame side members define an interior having substantially the same interior cross-dimension as the stationary frame. In highly preferred embodiments, each opposed seat frame side member has a vertical dimension substantially the same as the stationary frame side member vertical dimension. Regardless, the lower surface/portion of the seat frame member can include at least one support member arranged and configured to provide for a substantially uniform height framework, when the mechanism is extended as described herein.

Without limitation to any particular component, mechanism, article or apparatus otherwise described herein, the present invention also includes a method of using a seat portion to convert a seating article to a support framework. The support framework can then be used as otherwise described herein to provide for a substantially horizontal rest surface. Such a method can be accomplished by (1) providing a stationary frame having a back end and a forward end, and a seat portion having an upper surface and a lower surface with the lower surface coupled to the stationary frame; and (2) radially moving the seat portion to a position forward the stationary frame. The radial movement of the seat portion is substantially about a point on the forward end of the stationary frame. In preferred embodiments and as otherwise described herein, the seat portion can further include opposed side members; likewise, the stationary frame can further include opposed side members. In highly preferred embodiments, each set of opposed side members has a vertical dimension substantially the same as the other, such that radial movement as described herein and depicted in the accompanying figures results in a framework which can horizontally support a rest surface.

The present invention can also include a method of using a pivotable seat portion of a seating article to convert the article to a substantially horizontal rest surface. Again, such a method can be used without limitation to any one seating article and can be used by: (1) providing a stationary frame having a back end and a forward end, a seat portion having an upper surface and a lower surface, with the lower surface pivotably coupled to a forward end of the stationary frame, and a back rest member coupled to the stationary frame; (2) moving a seat portion through an angle greater than about 90 degrees to a position forward the stationary frame; and (3) pivoting the back rest toward the front end of the stationary frame to position it on the stationary frame, the seat portion or both. While the back rest member can have various configurations, a preferred embodiment thereof includes first and second rest portions, with the first portion coupled to and facing the second portion. In highly preferred embodiments, the second rest portion is extensibly coupled behind the first rest portion. As such, the first rest portion can be pivoted, and the second rest portion can be extended, to together provide a substantially horizontal rest surface. As described more fully above, the method of this invention can utilize seat portions and stationary frame having opposed side members, the vertical dimensions of each proportioned to provide the support necessary for a horizontal rest surface.

One embodiment of the present invention is illustrated in FIG. 1. As shown therein, chair 10 includes stationary frame 12, which can further include vertical side members 14. Seat portion 16, on frame 12, can further include corresponding side members 18. Seat portion 16 and stationary frame 12 can, optionally, further include edge members 20 and feet 22, respectively. Back rest 24, partially shown in FIG. 1, can further include first and second rest portions 26 and 28, respectively. In preferred embodiments of the present invention, seat portion 16 of chair 10 is coupled to stationary frame 12 toward the forward end thereof. Likewise, in preferred embodiments, back rest 24 is coupled to stationary frame 12 toward the rear end thereof. A variety of coupling mechanisms, consistent with the invention and function described herein are well known to those skilled in the art. However, back rest 24 is pivotably coupled to stationary frame 12 with a bolt and U-setting arrangement. Likewise, and as illustrated in subsequent figures, seat portion 16 is preferably and pivotably coupled to stationary frame 12 with a dual-action hinge.

As shown by the directional arrow in FIG. 1, seat portion 16 can be maneuvered to the position show in FIG. 2. Adequate support is provided by coordinated dimensions of edge members 20 and feet 22. Consideration is also given to the overall vertical dimensions of side members 14 and 18, or frame 12 and seat portion 16, respectively. In preferred embodiments, the vertical dimensions of each such member are substantially the same.

With reference to FIG. 2, movement of seat portion 16 about stationary frame 12 exposes lower surface 30 of seat portion 16. In preferred embodiments, such movement is about the forward end 32 of stationary frame 12. As illustrated in FIG. 2, pivot component 34 facilitates the corresponding angular movement of seat portion 16. In preferred embodiments, lower surface 30 further includes at least one back rest support 36. Back rest 24 can then be maneuvered about pivot component 38 and thereafter supported by aforementioned back rest supports 36 and cross-member 40. It is noted that seat cushion 42, illustrated schematically, is positioned downward between side members 18 upon radial movement of seat portion 16.

As shown in FIG. 3, back rest 24 can be moved about pivot component 38 and positioned on stationary frame 12. While not shown in FIG. 3, back rest 24 can preferably be positioned on cross-member 40. Other support configurations can be envisioned, in accordance with this invention; for instance, back rest member 24 can be dimensioned so as to have first rest portion 26 positioned upon one of more back rest support members 36. Movement of second rest portion 28, according to the directional arrow in FIG. 3, provides a substantially horizontal surface such as that illustrated in FIG. 4. Other aspects in accordance with the present invention are illustrated in FIG. 5. In particular, pivot component 34 can be secured to stationary frame side member 14 by way of pivot attachment member 44. Upon movement of seat portion 16 about forward end 32 of frame 12, there is revealed an optional compartment 46 for storage of various linen or bedding items. While unseen in the view presented in FIG. 5, it can be envisioned that frame 12 further includes a lower horizontal floor component between side member 14.

Figure 6:
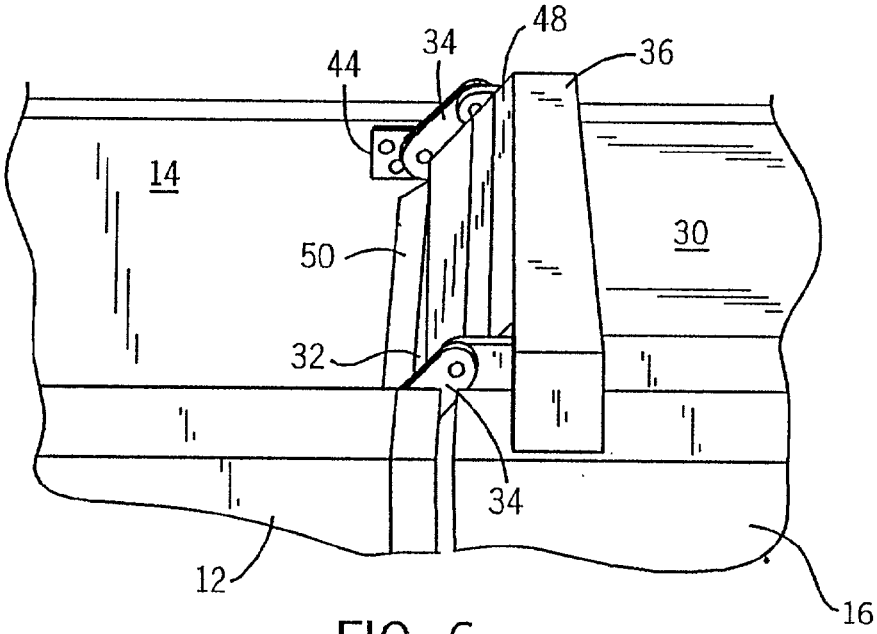
FIG. 6 shows, in enlarged fragmentary view and in accordance with this invention, various components useful in the extension and support of the inventive seating article, framework and/or mechanism.

The enlarged fragmentary prospective view provided in FIG. 6 shows several aspects in accordance with the present invention which can be utilized with preferred embodiments thereof. In particular, back rest support 36 can include angled component 48 which can have a complimentary angular relationship to cross-member 50. Cross-member 50 can comprise an uppermost portion of forward end 32 of frame 12 or, alternatively, be used in a linearly fashion between vertical side members 14. As further provided in FIG. 6, a preferred dual-action capability is illustrated by pivot component 34.

Figure 7:
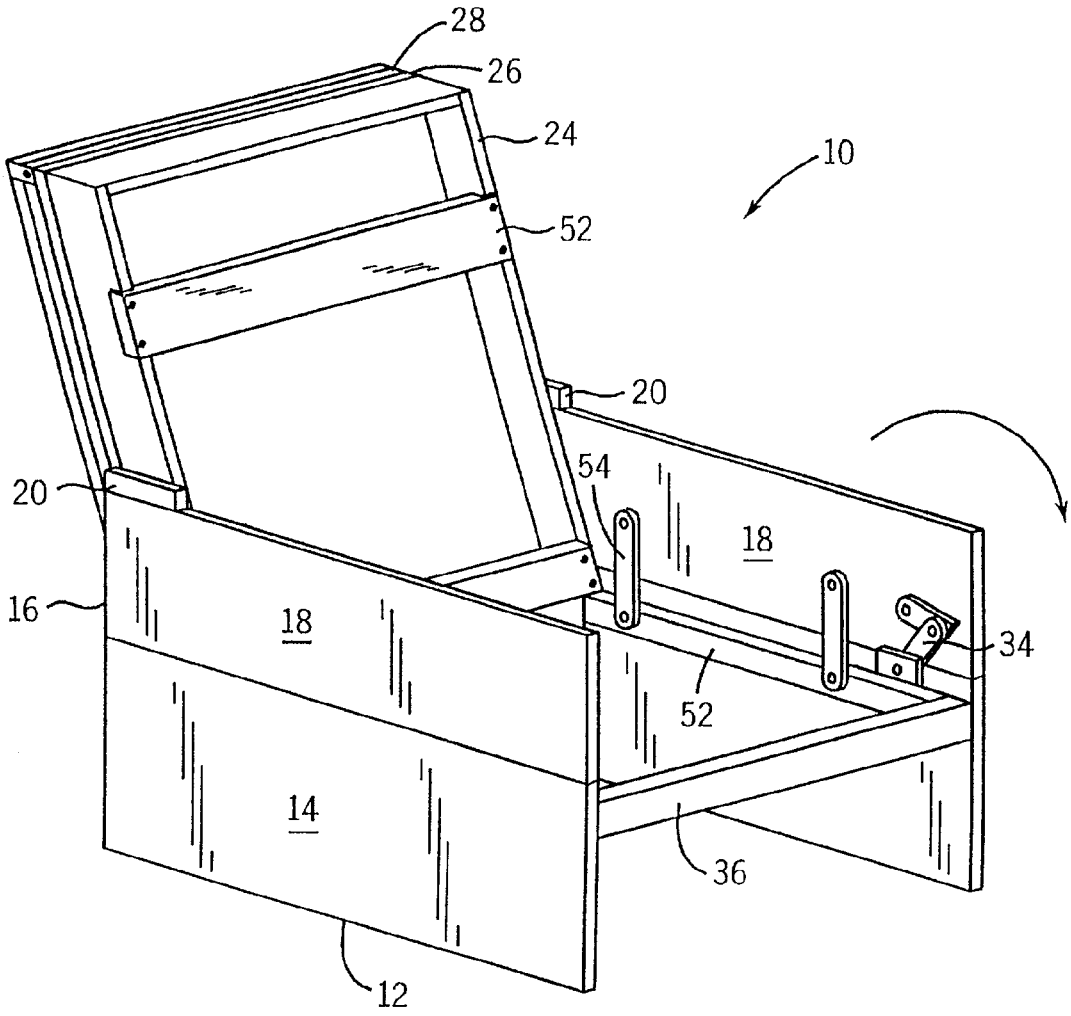
FIGS. 7–9 show alternate components, configurations, mechanisms and/or embodiments of the present invention, in a serial manner from a seating position to a substantially horizontal rest position.
Figure 8:
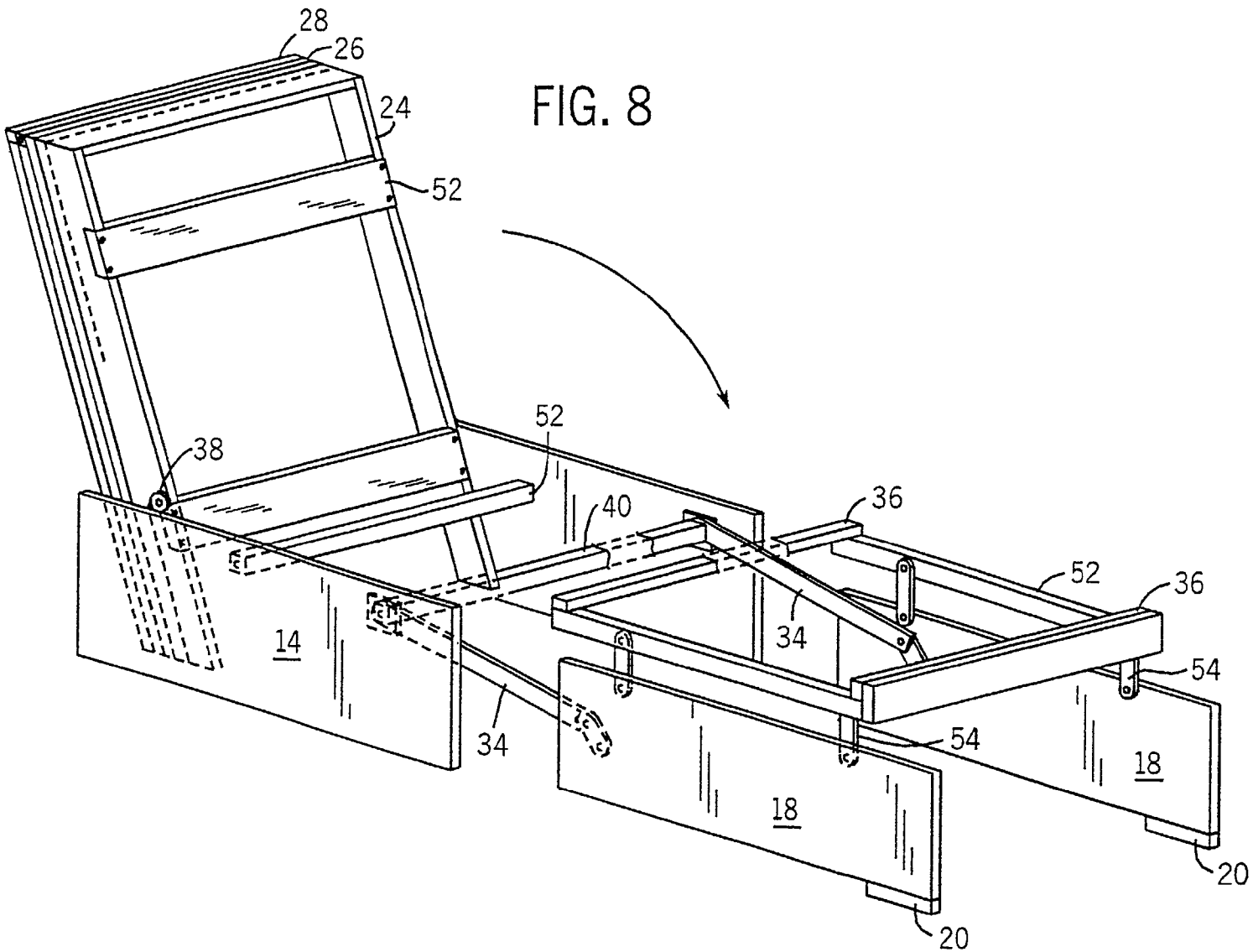
Figure 9:
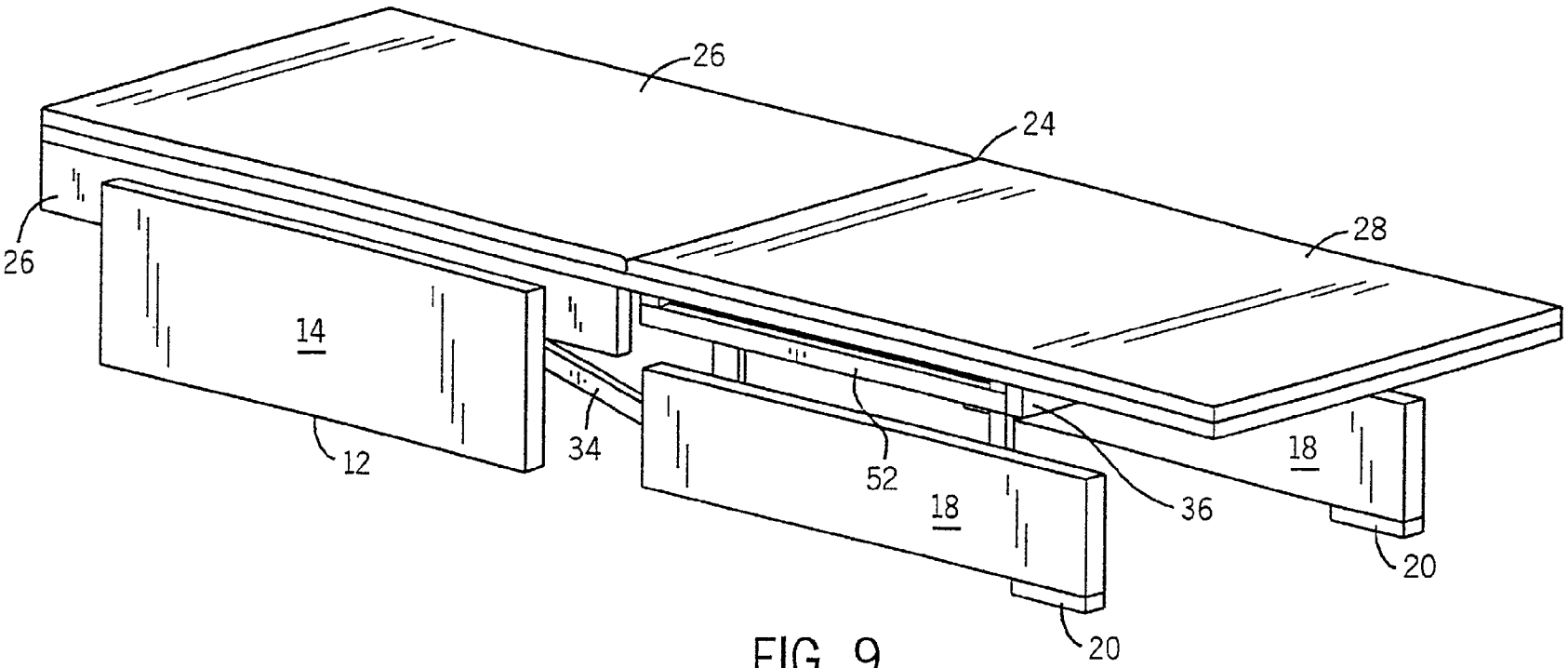

FIGS. 7–9 illustrate various structural components of the article and/or mechanism of the present invention, such components as can be utilized with the embodiments of FIGS. 1–6 or as can be used with other embodiments consistent with this invention. Both FIGS. 1–6 and FIGS. 7–9 also illustrate sequentially the broader methodology underlying this invention. Various other cross and vertical support members 52 and 54, respectively, are shown in FIGS. 7 and 8. Seat portion side members 18 can be pivoted about the forward end of stationary frame 12 to provide the substantially horizontal framework illustrated in FIG. 8. Particular reference is made to pivot component 34 which can be, preferably, a dual-action hinge mechanism. Utilizing components of the sort shown in FIG. 8 provides another representative mechanistic configuration. Depending upon the particular pivot component utilized, movement of side members 18 about the forward end of side members 12 can result in the spatial orientation between members 14 and 18 shown in FIG. 8. Other such spatial orientations are possible through choice of pivot component and the corresponding arrangement of frame members.

With reference to FIG. 9, the components, mechanism and resulting framework illustrated therein can be utilized to support extended back rest 24. Various support configurations can be utilized, in accordance with this invention. However, the component framework of FIG. 9 shows support of first rest portion 26 on stationary frame 12 and support of second rest portion 28 on support members 36.

As referenced above, the mechanism of this invention allows configuration of a chair and/or seating article which overcomes the functional and structural limitations of the reclining or extending chairs of the prior art. Foremost among the available benefits is facile conversion of an upright chair with an angled seat portion to a rest surface comprising a seat distal to a back rest portion. Operation of the extensible mechanism positions the seat portion in front of a stationary frame for support of the back rest. Mechanism retraction returns the article to an upright position, without the need for rearrangement and/or replacement of cushion supports. The mechanism of the present invention also allows the chair article to be extended or retracted without undue hazard to unwary users.

The substantially-planar horizontal and/or supine surface so obtained is preferable for long periods of restful sleep in surroundings which, for reasons of decorum and area constraint, do not permit placement of cots, twin beds, or the like. As such, the chair articles of the present invention are ideally suited for use in a health care setting or environment. Through use of the present invention, in-patient care is now available with accommodations for friends, spouses, or relatives who wish to remain close without incurring additional lodging expenses. Likewise, overnight stays in a patient's room need no longer be accompanied by interrupted sleep or back and related body aches.

Changes and modifications to the present invention can be made without departing from the invention in its broader aspects. Therefore, the embodiments illustrated in FIGS. 7–9 can be considered and utilized in light of the features otherwise described, shown, or as would be reasonably inferred by those skilled in the art from FIGS. 1–6 and the accompanying description. The appended claims are intended to cover all such variations, changes and modifications.

Chair article 10 and other embodiments, along with their component parts and mechanisms, can be made using a variety of commercially available materials and methods well-known to those in the art. See, for instance, U.S. Pat. Nos. 5,743,594 and 5,779,310, of which the specification of each is incorporated herein in its entirety.

In highly preferred embodiments, the seating articles of the present invention can be manufactured to meet or exceed various flame retardancy requirements, including those of California Technical Bulletin 133, as well as those of Port Authority of New York, the State of New Jersey, and that promulgated through the City of Boston Fire Code.

It will be appreciated by those skilled in the art that the materials used in the construction of the extendable chair and mechanism of the present invention and the dimensions used in the various components thereof will be selected for a particular use situation. Although several specific configurations of the inventive chair and mechanism have been illustrated and described, those skilled in the art will appreciate that alternate configurations can be utilized.

While the principles of this invention have been described in connection with specific embodiments, it should be understood clearly that these descriptions are made only by way of example and are not intended to limit the scope of the invention, in any manner. For example, various configurations are possible such that love seats, settees and the like can also be extended to provide horizontal surfaces, as described herein. Other advantages and features of the invention will become apparent from the claims hereinafter, with the scope of the claims determined by the reasonable equivalents as understood by those skilled in the art.

The invention claimed is:

1. An extendible chair, comprising:

a stationary frame including two vertical side members defining a cross-dimension, each said member having a back end and a forward end;

a seat portion having an upper surface and a lower surface, said lower surface pivoting on and about a forward end of said stationary frame side member; and a back rest member pivotably coupled rearward to and within said stationary frame, said back rest member pivoting downward toward said forward end of said stationary frame.

2. The chair of claim 1 wherein said seat portion further includes opposed side members.

3. The chair of claim 2 wherein said seat side members define an interior having substantially the same cross-dimension as said stationary frame.

4. The chair of claim 3 wherein each opposed seat side member has a vertical dimension substantially the same as said vertical dimension of each said stationary frame side member.

5. The chair of claim 1 wherein said back rest comprises first and second rest portions, one said portion coupled to and facing said other rest portion.

6. The chair of claim 5 wherein said second rest portion is extendibly coupled behind said first rest portion.

7. The chair of claim 6 wherein said first rest portion, pivoted, and said second rest portion, extended, together provide a substantially horizontal rest surface.

8. The chair of claim 7 wherein said pivoted first portion is positioned on said stationary frame and said extended second portion positioned on said seat portion.

9. An extendible chair, comprising:

a stationary frame including two vertical side members defining a cross-dimension, each said member having a back end and a forward end;

a seat portion having an upper surface and a lower surface, said lower surface pivotably coupled forward said seat portion to a forward end of said stationary frame side member, said seat portion rotating approximately 180 degrees when pivoted, wherein said lower surface of said seat portion includes at least one back rest support member; and a back rest member pivotably coupled rearward to and within said stationary frame.

10. The chair of claim 9 wherein said seat portion further includes opposed side members.

11. The chair of claim 10 wherein said seat portion includes two back rest support members on said lower seat portion surface, each said support member attached to each of said opposed seat side members.

12. A method of using a pivotable portion of a seating article to convert said article to a substantially horizontal rest surface, said method comprising:

providing a stationary frame having a rear end and a forward end, a seat portion having an upper surface and a lower surface with said lower surface pivoting on and about a forward end of said stationary frame, and a back rest member pivotably coupled rearward to and within said stationary frame;

moving said lower surface of said seat portion through an angle of greater than about 90 degrees to a position forward said stationary frame; and pivoting said back rest toward said forward end to position said back rest on at least one of said stationary frame and said seat portion.

13. The method of claim 12 wherein said seat portion further includes opposed side members, and said stationary frame further includes opposed side members.

14. The method of claim 13 wherein each opposed seat side member has a vertical dimension substantially the same as the vertical dimension of each said stationary frame side member.

15. The method of claim 12 wherein said back rest member comprises first and second rest portions, one said rest portion coupled to and facing said other rest portion.

16. The method of claim 15 wherein said second rest portion is extensibly coupled behind said first rest portion.

17. The method of claim 16 wherein said first rest portion is pivoted and said second rest portion is extended, to provide a substantially horizontal rest surface.

18. A method of using a pivotable portion of a seating article to convert said article to a substantially horizontal rest surface, said method comprising:

providing a stationary frame having a rear end and a forward end, a seat portion having an upper surface and a lower surface with said lower surface pivotably coupled to a forward end of said stationary frame, and a back rest member pivotably coupled rearward to and within said stationary frame, wherein said lower surface of said seat portion includes at least one back rest support member;

moving said lower surface of said seat portion through an angle of greater than about 90 degrees to a position forward said stationary frame; and pivoting said back rest toward said forward end to position said back rest on at least one of said stationary frame and said seat portion.

* * * * *